US009095218B1

(12) United States Patent
Wu

(10) Patent No.: US 9,095,218 B1
(45) Date of Patent: Aug. 4, 2015

(54) BOTTOM PLATE STRUCTURE OF A CHAIR

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 0 days.

(21) Appl. No.: 14/459,792

(22) Filed: Aug. 14, 2014

(51) Int. Cl.

| | |
|---|---|
| ***A47C 1/024*** | (2006.01) |
| ***A47C 7/44*** | (2006.01) |
| ***A47C 7/02*** | (2006.01) |
| ***A47C 3/00*** | (2006.01) |

(52) U.S. Cl.
CPC . *A47C 7/441* (2013.01); *A47C 3/00* (2013.01); *A47C 7/02* (2013.01)

(58) Field of Classification Search
CPC ..... A47C 7/441; A47C 7/02; A47C 3/00; A47C 3/18; A47C 3/30; A47C 1/023; A47C 7/402
USPC ..... 297/340, 341, 311, 300.2
See application file for complete search history.

(56) References Cited

U.S. PATENT DOCUMENTS

| | | | | | |
|---|---|---|---|---|---|
| 702,540 | A | * | 6/1902 | Clark et al. | 297/319 |
| 847,880 | A | * | 3/1907 | Barker et al. | 297/319 |
| 967,665 | A | * | 8/1910 | Piche' | 297/317 |
| 2,471,024 | A | * | 5/1949 | Cramer | 297/300.5 |
| 3,416,839 | A | * | 12/1968 | Flint | 297/396 |
| 4,796,952 | A | * | 1/1989 | Piretti | 297/300.5 |
| 6,161,897 | A | * | 12/2000 | Kurtz et al. | 297/321 |
| 6,685,267 | B1 | * | 2/2004 | Johnson et al. | 297/300.1 |
| 2007/0290537 | A1 | * | 12/2007 | Lin | 297/300.2 |

* cited by examiner

*Primary Examiner* — Milton Nelson, Jr.
(74) *Attorney, Agent, or Firm* — Ming Chow; Sinorica, LLC

(57) ABSTRACT

A bottom plate structure of a chair has a bottom plate, a back rack and a seat frame. The bottom plate has an elastic support device, a slanting device and an adjusting device. The elastic support device has at least one resilient sheet mounted in the bottom plate, an adjusting component mounted in the bottom plate, and a supporting base connected to the adjusting component. The slanting device has a pivoting component connected to the back rack, a transmission seat mounted in the bottom plate, and two fastening members connected to the bottom plate. The pivoting component has two pivoting arms. The transmission seat has a pulling component connected to the transmission seat. The adjusting device is mounted between the bottom plate and the seat frame, and has a back pivoting component and a front adjusting component mounted on the seat frame and the bottom plate.

18 Claims, 18 Drawing Sheets

BOTTOM PLATE STRUCTURE OF A CHAIR

BACKGROUND OF THE INVENTION

1. Field of the Invention

The present invention relates to a bottom plate of a chair, especially a bottom plate structure that has multiple adjusting functions.

2. Description of the Prior Arts

A conventional chair comprises a bottom plate, a back rack and a seat frame. The back rack is always pivotally and elastically connected to the bottom plate and rotates relative to the bottom plate. So a user can stretch his or her body for relaxation.

For accomplishing the relaxing effect, an elastic component is applied to connect the bottom plate and the back rack. When the user leans against a backrest of the back rack, the elastic component is stretched and the back of the users can be stretched. When the user no longer leans against a backrest of the back rack, the back rack is repositioned to the original position by the elastic component.

However, the conventional elastic component is stretched by the back rack and the elasticity of the elastic component is fixed and unadjustable. When the user sits and leans against the back rack for a long period of time, the elastic component is fatigued by the leaning forces of the users, and this affects the sitting comfort provided by the chair. Furthermore, different users may have different requirements of elasticity, and the users may hope that the elasticity of the elastic component can be adjusted to meet different conditions, but the conventional elastic component does not have the elasticity adjusting function.

In addition, the user needs to adjust the back inclined angle of the back rack for matching the different using conditions. When the user sits on the chair in a causal situation, the back rack is adjusted to a specific back inclined angle, so the back of the user can be stretched for relaxation. When the user is involved in some work by sitting upright on the chair, the back rack is adjusted to a vertical angle for supporting the user.

But the back rack of the conventional chair provides only two adjusting positions to the users rather than having multiple back inclined angles, one of the adjusting positions is vertical and the other one of the adjusting positions is a specific back inclined angle, thus the adjusting function of the back rack of the conventional chair is inadequate to the users.

Additionally, a cushion is mounted on the seat frame of the conventional chair. As usual, the seat frame is mounted securely on the bottom plate with a front inclined angle for improving the comfort of the chair. So the front inclined angle of the seat frame is unadjustable. However, when the users sit on the conventional chair, the users with different heights may prefer different front inclined angles. The conventional chair obviously cannot meet the usage demands.

To overcome the shortcomings, the present invention provides a bottom plate structure of a chair to mitigate or obviate the aforementioned problems.

SUMMARY OF THE INVENTION

The main objective of the present invention is to provide a bottom plate structure of a chair that has multiple adjusting functions including adjustments of an elastic support device, a slanting device and an adjusting device. So the present invention can meet different usage demands of users by adjusting the elastic support device, the slanting device and the adjusting device.

The bottom plate structure of a chair has a bottom plate, a back rack pivotally connected to the bottom plate, and a seat frame mounted on the bottom plate in front of the back rack. The bottom plate has an elastic support device, a slanting device and an adjusting device. The elastic support device includes at least a resilient sheet mounted in the bottom plate, an adjusting component, and a supporting base. A front end of the resilient sheet is connected securely in the bottom plate, a rear end of the resilient sheet is connected to the back rack in the bottom plate, the adjusting component is mounted in the bottom plate under the resilient, and the supporting base is movably connected to the adjusting component. The supporting base is located under the resilient sheet and contacts the resilient sheet.

The slanting device includes a pivoting component connected to the back rack, a transmission seat mounted in the bottom plate, and two fastening members connected to two sides in the bottom plate. The pivoting component has two pivoting arms pivotally connected to the bottom plate and securely mounted with the back rack, and multiple insertion slots formed oppositely on two inner surfaces of the pivoting arms. The insertion slots are arranged in a fan shape. The transmission seat is located in a center of the bottom plate and has two cylinders extending from two bottom surfaces of the transmission seat, a pulling component connected to the transmission seat, two fastening members pivotally mounted in the bottom plate and having two inclined holes respectively mounted through by the cylinders of the transmission seat, two fastening sheets formed on a rear end of the fastening members and fastening in the insertion slots.

The adjusting device is mounted between the bottom plate and the seat frame and has a back pivoting component and a front adjusting component. The back pivoting component is mounted on a rear end of the seat frame and the bottom plate. The front adjusting component is mounted on a front end of the seat frame and the bottom plate. The front adjusting component is used to adjust a front inclined angle of the seat frame relative to the bottom plate.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
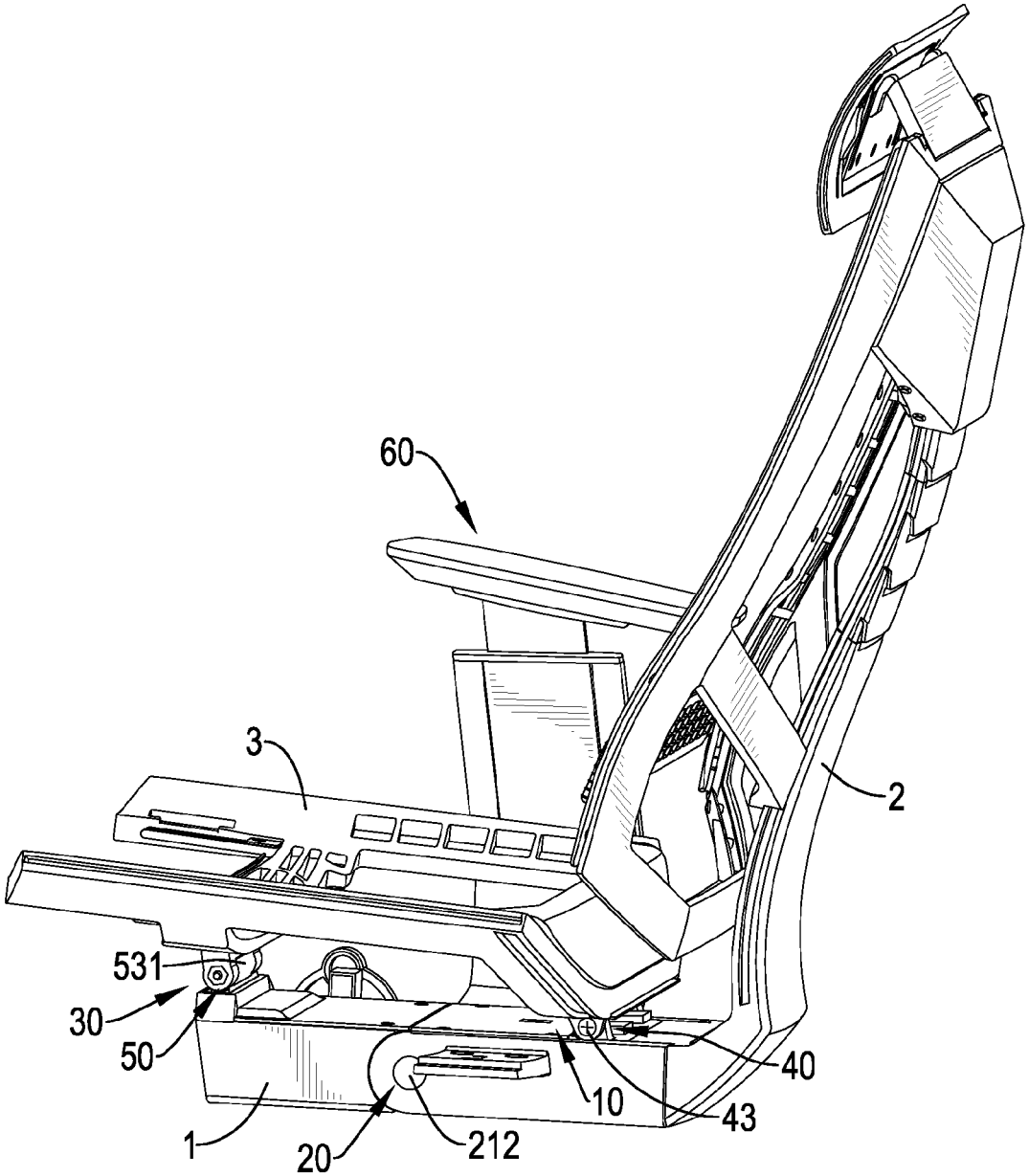
FIG. 1 is a perspective view of a bottom plate structure of a chair in accordance with the present invention.
Figure 2:
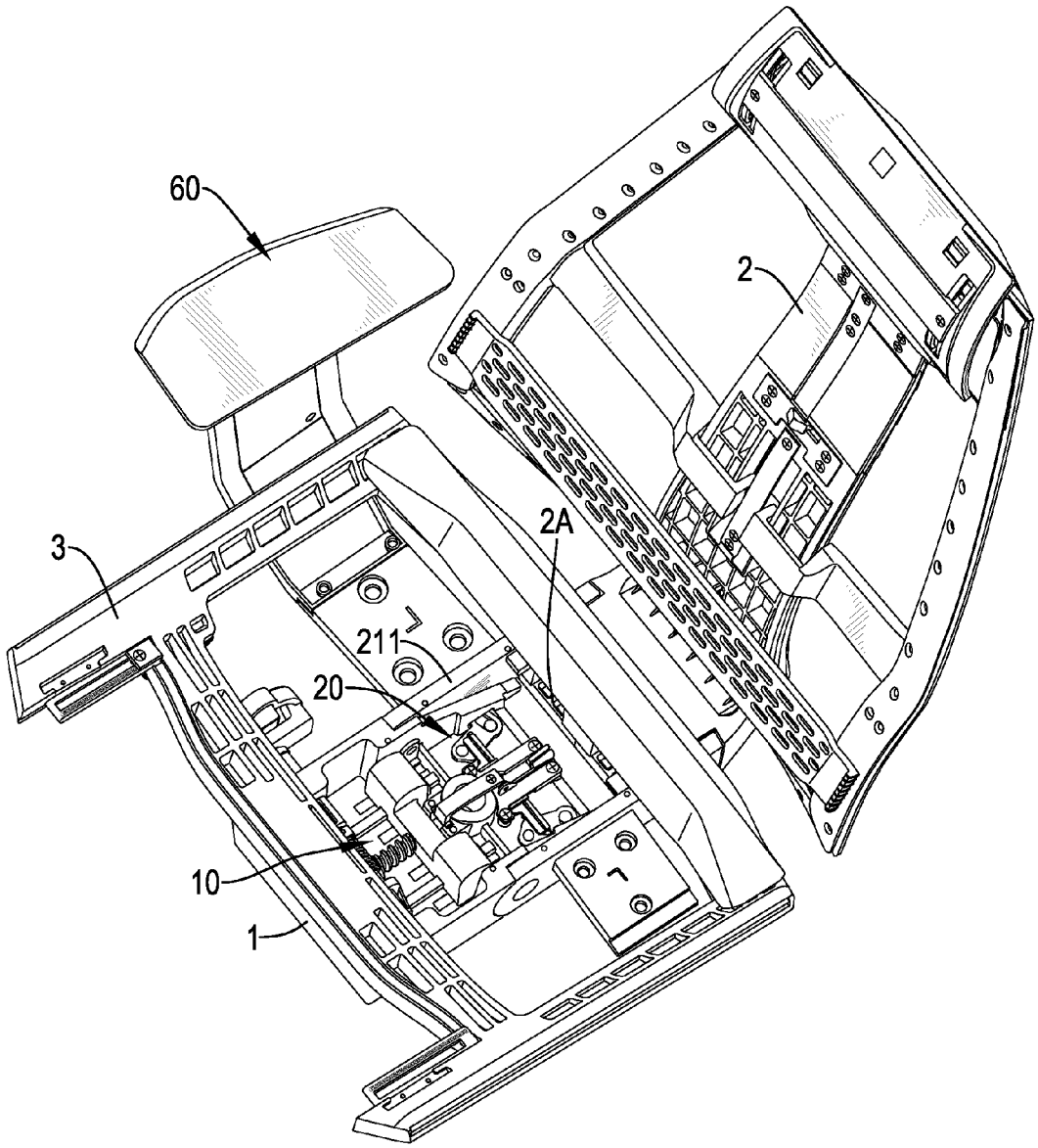
FIG. 2 is another perspective view of the bottom plate structure in FIG. 1.

With reference to FIGS. 1 and 2, a bottom plate structure of a chair in accordance with the present invention has a bottom plate 1, a back rack 2 and a seat frame 3.

The bottom plate 1 has a top surface, a front side, a receiving groove 1A, an elastic support device 10, a slanting device 20 and an adjusting device 30. The receiving groove 1A is formed in the top surface of the bottom plate 1 at the front side of the bottom plate 1. A bottom end of the back rack 2 is connected to a rear side of the bottom plate 1, and the back rack 2 has two installing grooves 2A. The seat frame 3 is rotatably mounted above the bottom plate 1.

Figure 3:
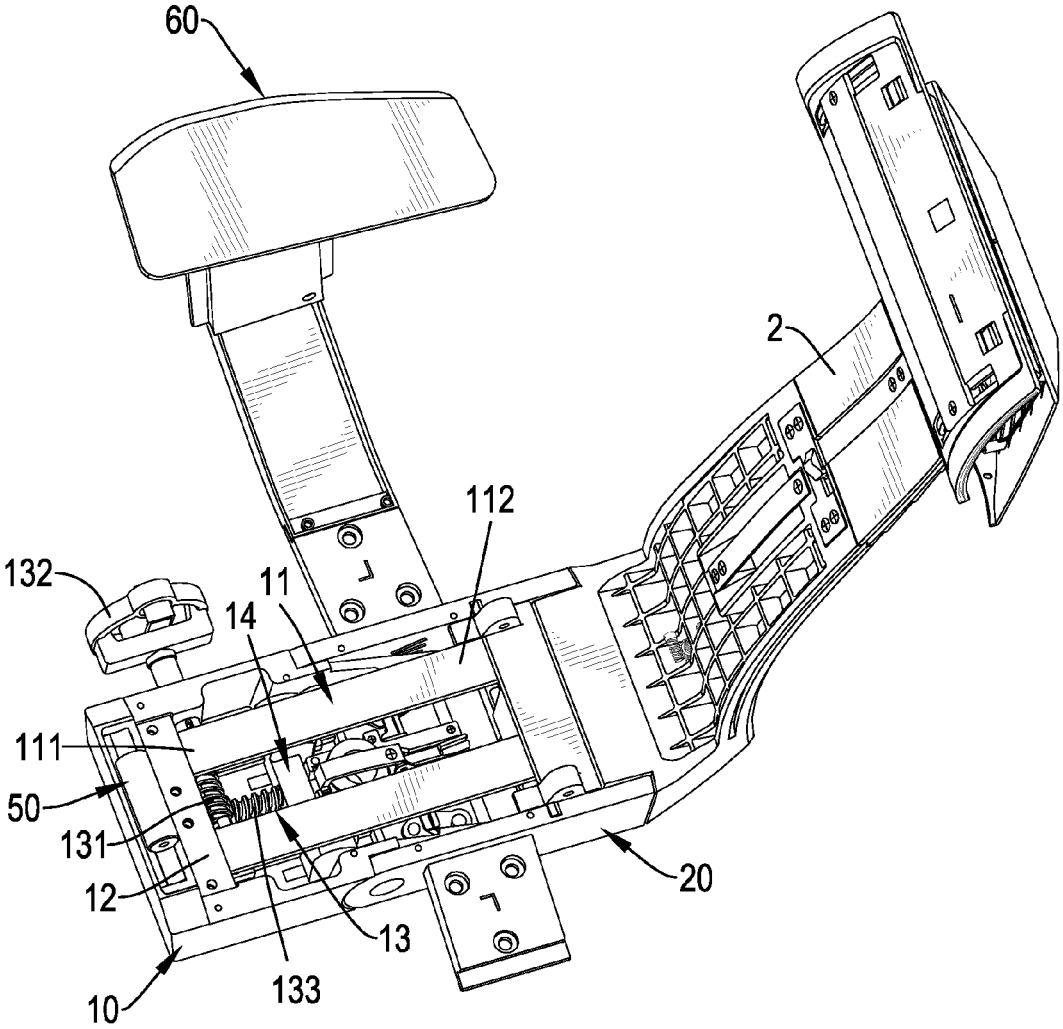
FIG. 3 is a partial perspective view of the bottom plate structure in FIG. 1.
Figure 4:
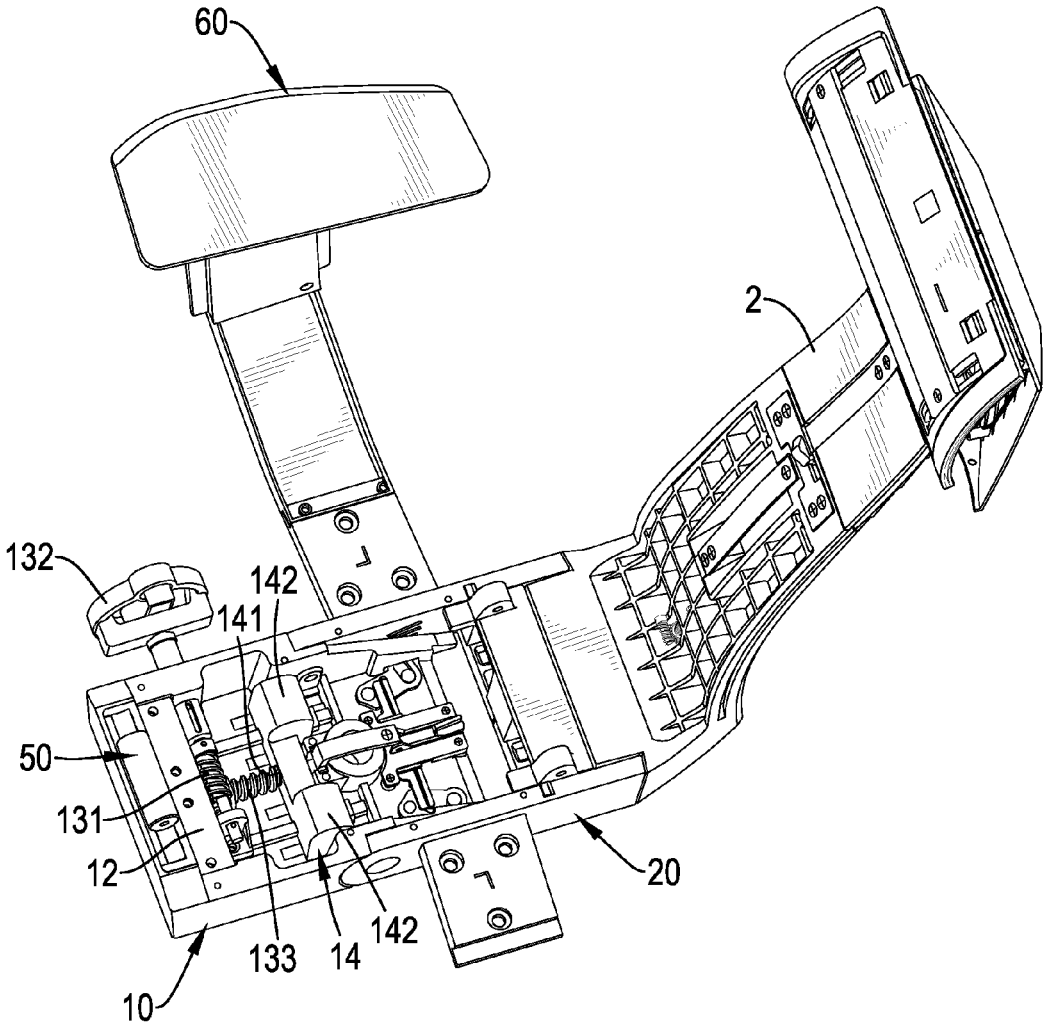
FIG. 4 is another partial perspective view of the bottom plate structure in FIG. 1.

With reference to FIGS. 2 to 4, the elastic support device 10 is mounted in the bottom plate 1 near the front side of the bottom plate 1 and has two resilient sheets 11, a fixing sheet 12, an adjusting component 13 and a supporting base 14. The resilient sheets 11 are mounted in the bottom plate 1 and are parallel with each other, and each one of the resilient sheets 11 has a front end 111 and a rear end 112. The rear ends 112 of the resilient sheets 11 are connected to the back rack 2 and are mounted in the installing grooves 2A. The fixing sheet 12 is located in the bottom plate 1 and is mounted securely on the front ends 111 of the resilient sheets 11.

The adjusting component 13 is mounted under the resilient sheets 11 and has an adjusting rod 131, a turning knob 132 and a transmission rod 133. The adjusting rod 131 is mounted pivotally in the bottom plate 1 near the fixing sheet 12. The turning knob 132 is mounted through a side surface of the bottom plate 1 and is connected to the adjusting rod 131 for turning the adjusting rod 131. The transmission rod 133 is mounted vertically and pivotally in the bottom plate 1 and engages the adjusting rod 131. In a preferred embodiment, the adjusting rod 131 has a worm and the transmission rod 133 has a worm wheel. The worm of the adjusting rod 131 engages the worm wheel of the transmission rod 133, so the transmission rod 133 is rotated by the adjusting rod 131 without displacement.

Figure 7:
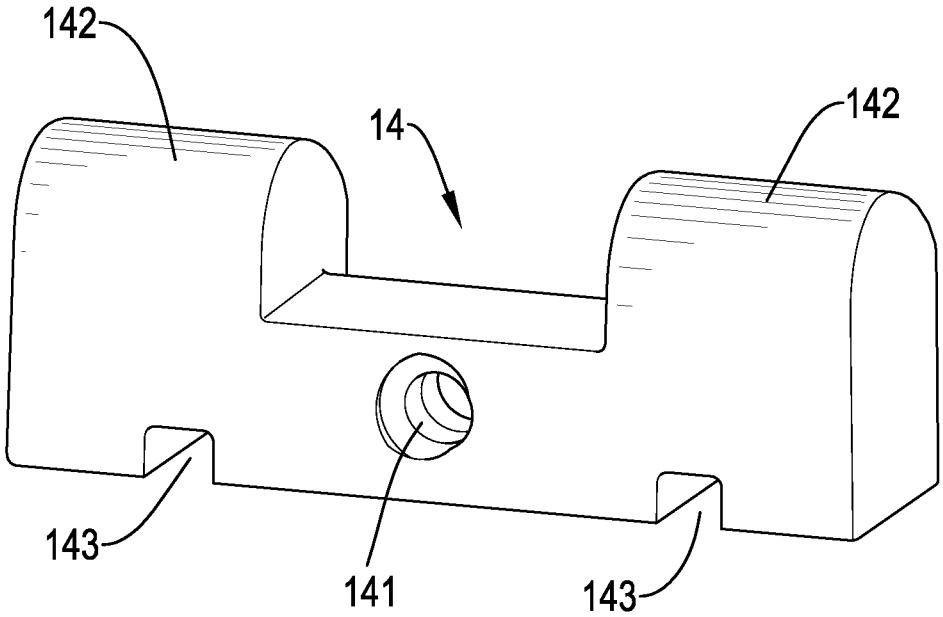
FIG. 7 is an enlarged perspective view of a supporting base of the bottom plate structure in FIG. 1.

With reference to FIGS. 3, 4 and 7, the supporting base 14 is mounted under the resilient sheets 11 and contacts two bottom surfaces of the resilient sheets 11, the supporting base 14 is vertically moveable in the bottom plate 1 and is driven by the adjusting component 13 for changing a contact position with the resilient sheets 11. The supporting base 14 has a screw hole 141, two lumps 142, and two track portions 143. The screw hole 141 is formed through the middle of the supporting base 14 and screwed with the transmission rod 133. The two lumps 142 are arced, respectively extend from a top surface of the supporting base 14, and contact the resilient sheets 11. The two track portions 143 are formed on a bottom surface of the supporting base 14. The track portions 143 can be grooves or protruding bars.

Figure 5:
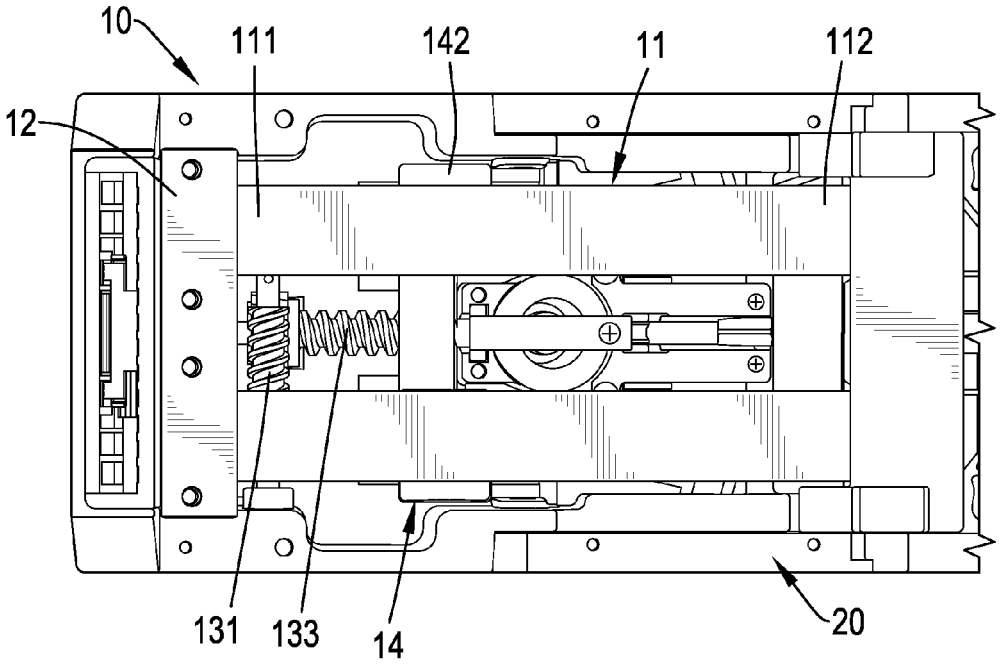
FIG. 5 is a top view of an elastic support device of the bottom plate structure in FIG. 1.
Figure 6:
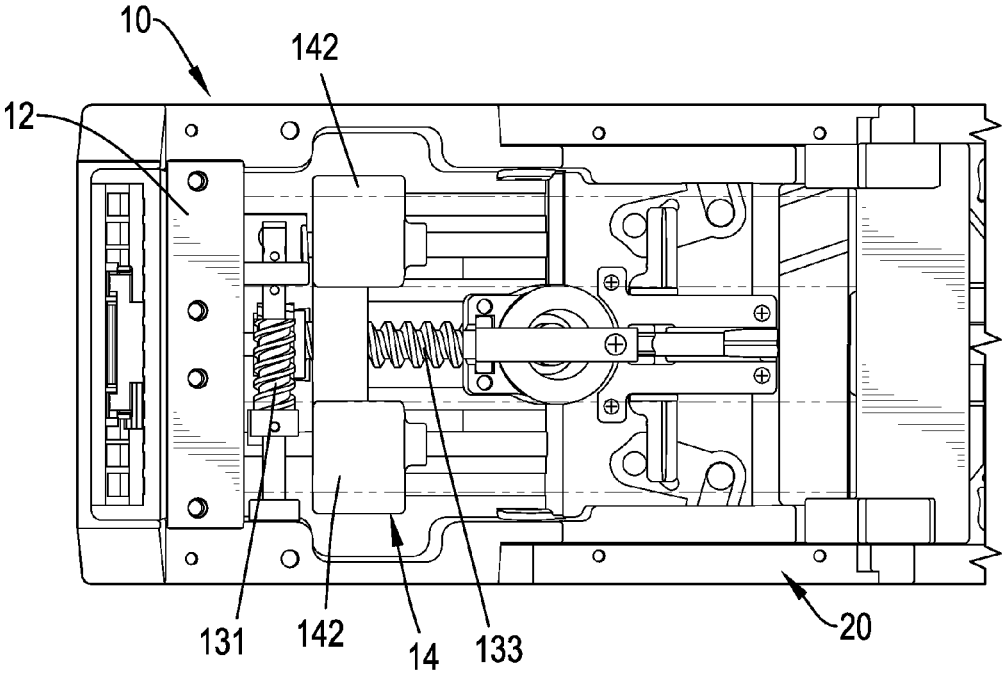
FIG. 6 is another top view of the elastic support device of the bottom plate structure in FIG. 1.

With reference to FIGS. 5 and 6, when turning the turning knob 132 and the adjusting rod 132, the transmission rod 133 is turned as well. Because of the screwing connection between the supporting base 14 and the transmission rod 133, the supporting base 14 moves along the transmission rod 133, thereby changing a contact position of the resilient sheets 11 and the lumps 142. So the elastic forces between the back rack 2 and the bottom plate 1 are changed.

Figure 8:
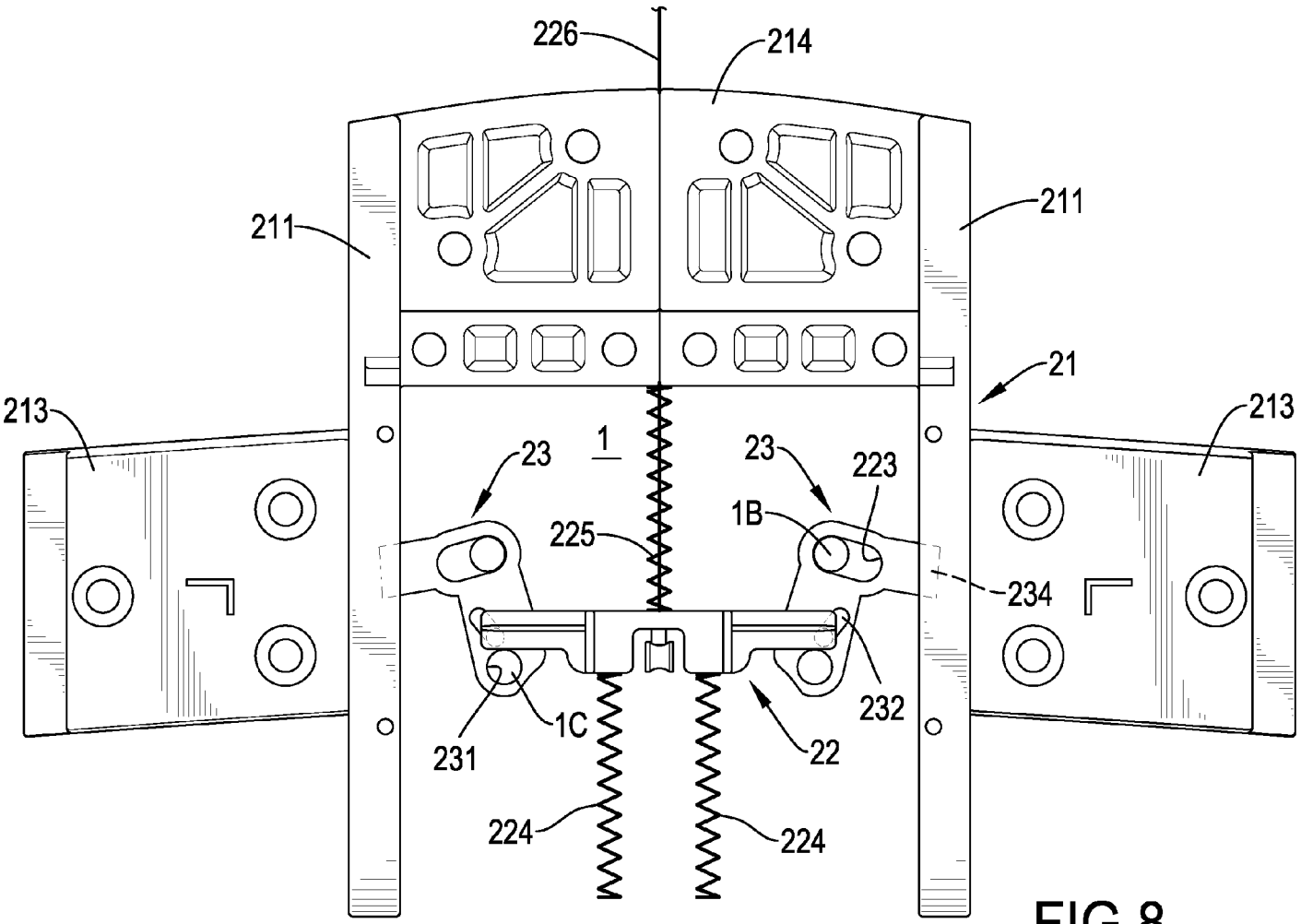
FIG. 8 is an operational top view of a slanting device of the bottom plate structure in FIG. 1.

With reference to FIGS. 1, 2 and 8, the slanting device 20 is connected to the bottom plate 1 and has a pivoting component 21, a transmission seat 22 and two fastening members 23.

Figure 9:
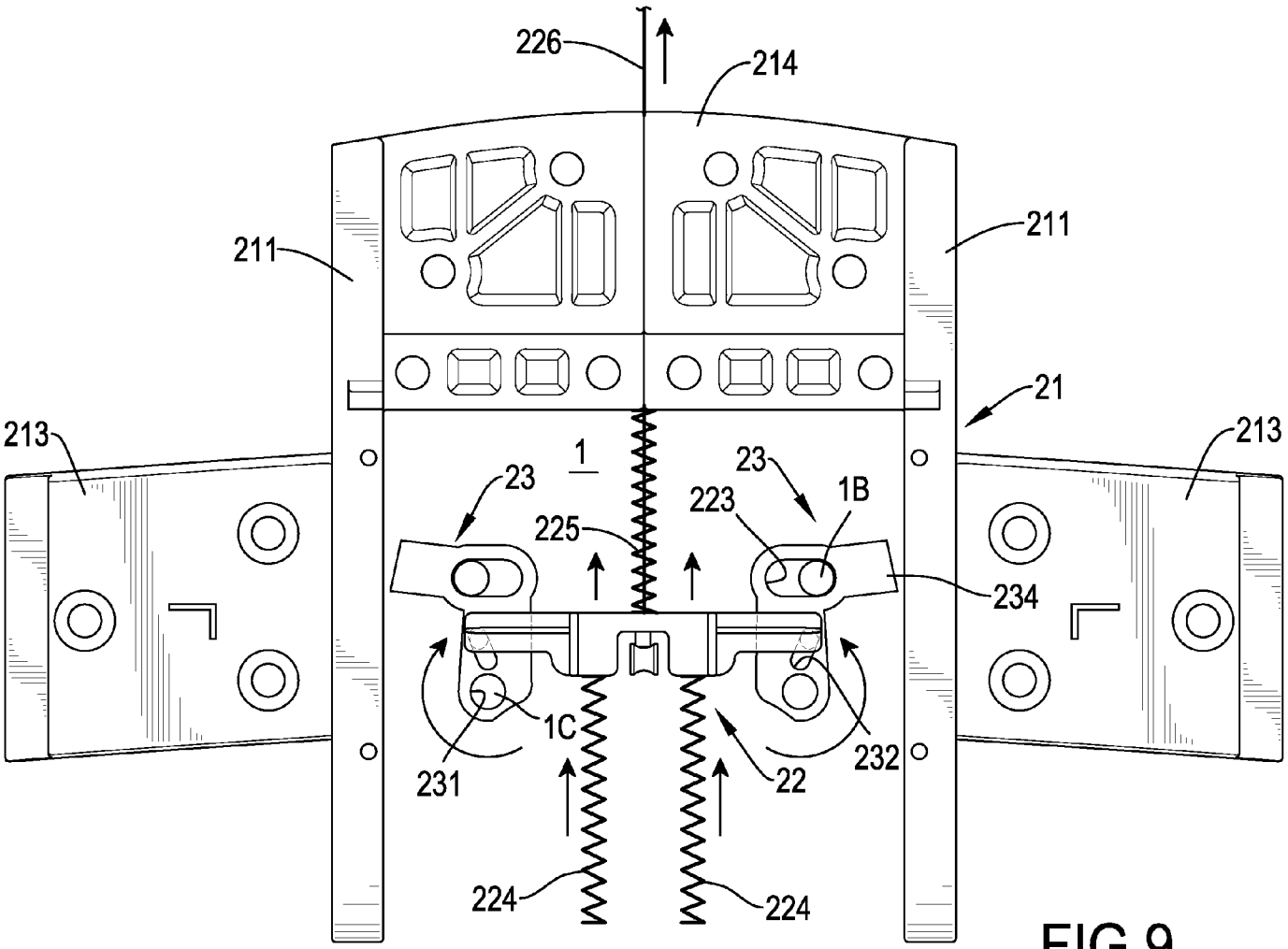
FIG. 9 is another operational top view of the slanting device of the bottom plate structure in FIG. 1.

With further reference to FIGS. 1, 8 and 9, the pivoting component 21 has two pivoting arms 211, two pivot holes 212, and two locating sheets 213. The two pivoting arms 211 are connected to two opposite sides of the bottom plate 1, the two pivot holes 212 are respectively formed through the pivoting arms 211, the pivoting arms 211 are pivotally connected to the bottom plate 1 and rotate round the pivot holes 212, and the two locating sheets 213 protrude from two outer surfaces of the pivoting arms 212. With reference to FIG. 1, a handrail component 60 is mounted securely on one of the locating sheets 213, an installing base 214 is mounted between the pivoting arms 211 and is connected to the back rack 2, and multiple insertion slots 215 are formed respectively on two inner surfaces of the pivoting arms 211 and are symmetrical to each other. The insertion slots 215 are arranged in a fan shape, and in a preferred embodiment, the pivoting component 21 has four insertion slots 215 formed on each of the pivoting arms 211.

Figure 10:
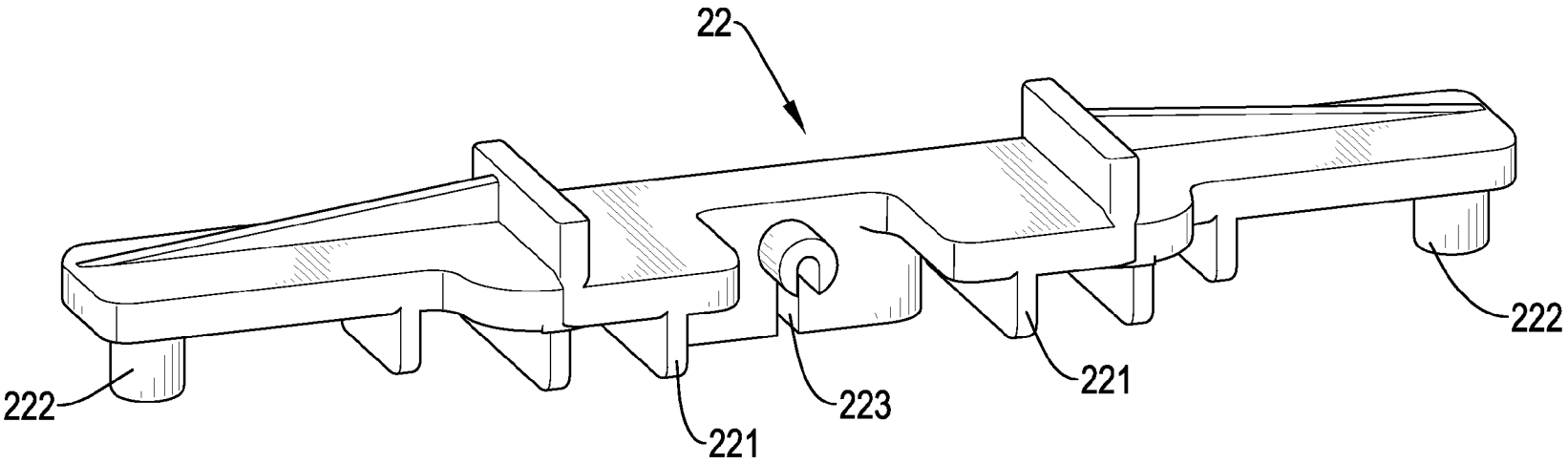
FIG. 10 is an enlarged perspective view of a transmission seat of the bottom plate structure in FIG. 1.

With reference to FIGS. 8 to 10, the transmission seat 22 is mounted in a middle of the bottom plate 1 and is in a symmetrical shape. The transmission seat 22 has two guiding portions 221, two cylinders 222, a through groove 223, two stretching springs 224, and a pressing spring 225. The guiding portions 221 are formed on the bottom of the transmission seat 22, and the transmission seat 22 can be moved straight in the bottom plate 1 by the guiding portions 221. The two cylinders 222 extend from two bottom surfaces of the transmission seat 22. The through groove 223 is formed through the transmission seat 22 and between the guiding portions 221. The two stretching springs 224 are connected to two front ends of the transmission seat 22 and the bottom plate 1. The pressing spring 225 is connected to a rear end of the transmission seat 22 and the installing base 214 of the pivoting component 21. The stiffness of the pressing spring 225 is larger than the stiffness of the stretching spring 224, so the transmission seat 22 is moved forwardly by the pressing spring 225 and a pulling component 226 is mounted securely in the through groove 223 of the transmission seat 22. One end of the pulling component 226 is positioned at a front end of the through groove 223, the pulling component 226 extending backwardly to the installing base 214 and connected to a knob; by pulling the knob, the transmission seat 22 can be pulled backward by the pulling component 226.

Figure 13:
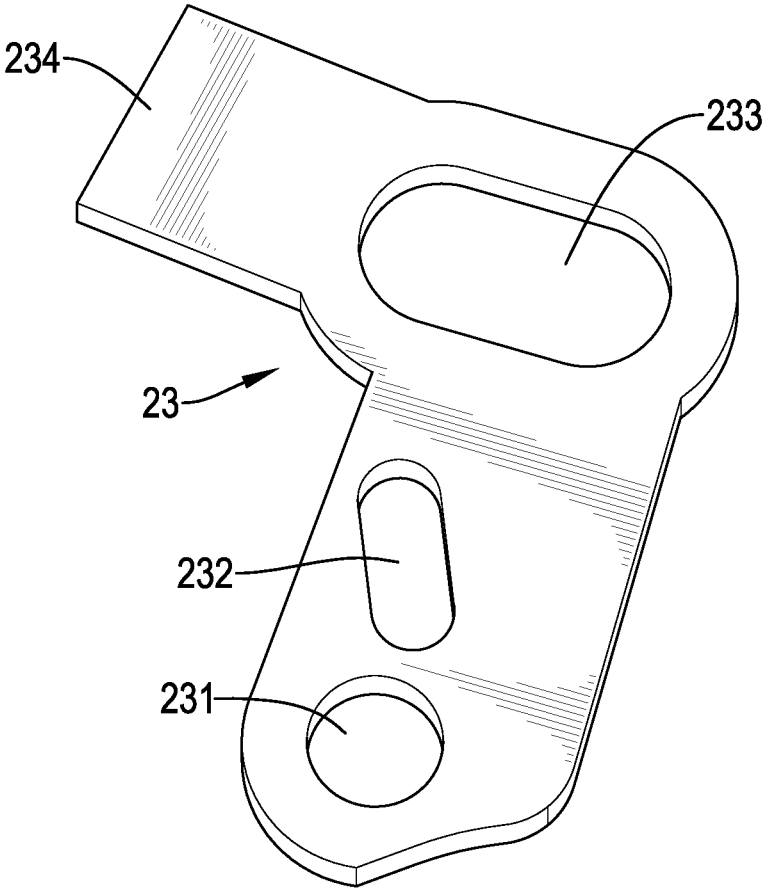
FIG. 13 is an enlarged perspective view of the fastening member of the bottom plate structure in FIG. 12.

With reference to FIGS. 8, 9 and 13, the fastening members 23 are mounted symmetrically between two sides of the transmission seat 22 and the pivoting arms 211, each fastening member 23 has a rotation hole 231, an inclined hole 232, a horizontal hole 233, and a fastening sheet 234. The rotation hole is formed through a front end of the fastening member 23. The inclined hole 232 is formed through the fastening member 23 behind the rotation hole 231, a front end of the inclined hole 232 is located away from the pivoting arm 211, and a rear end of the inclined hole 232 is located proximal to the pivoting arm 211. The horizontal hole 233 is formed behind the rear end of the inclined hole 232, and the fastening sheet 234 extends from an outer surface of the fastening member 23.

Figure 11:
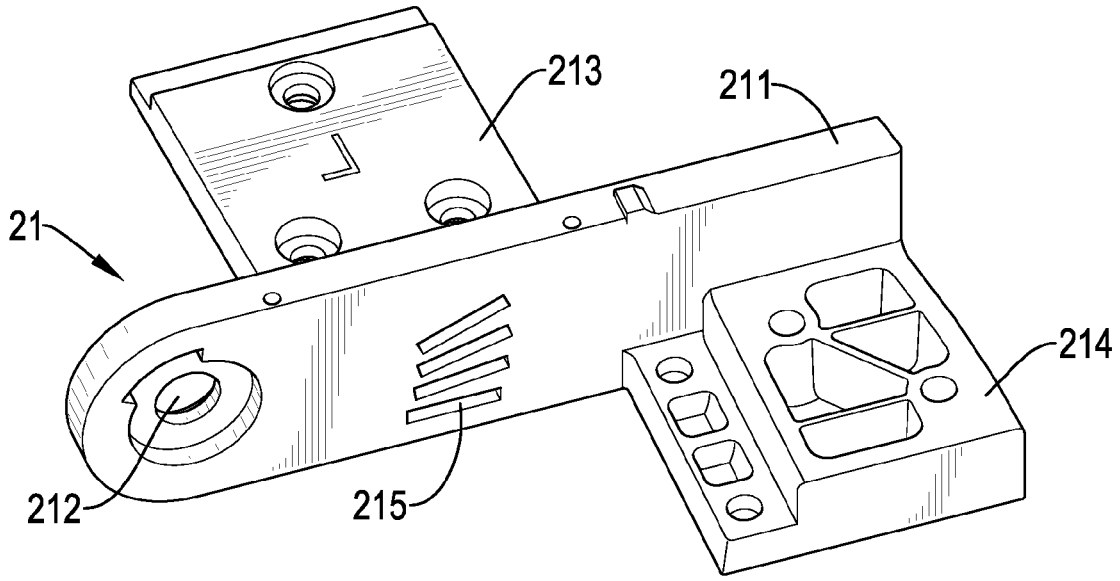
FIG. 11 is an enlarged perspective view of a pivoting arm of the bottom plate structure in FIG. 1.
Figure 12:
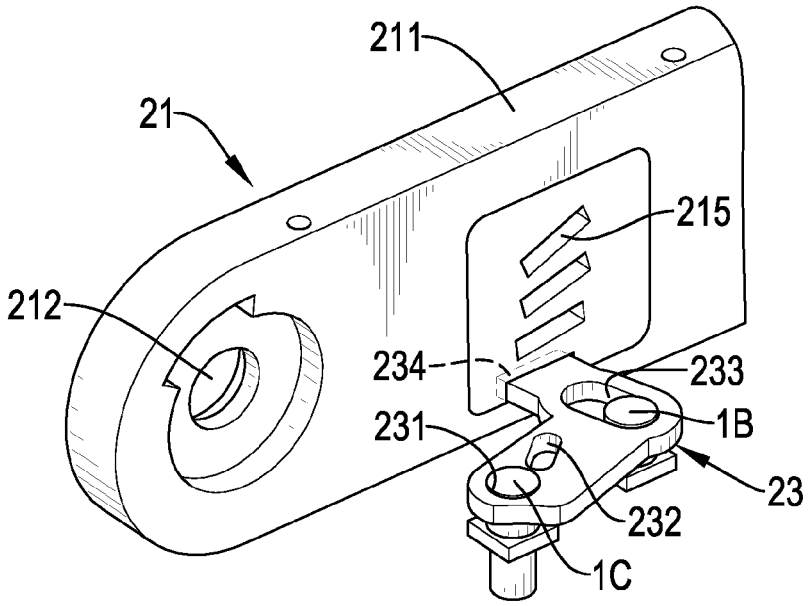
FIG. 12 is an operational perspective view of the pivoting arm and a fastening member of the bottom plate structure in FIG. 1.

With reference to FIGS. 8, 11 and 12, the bottom plate 1 has two shafts 1C mounted in the rotation holes 231 of the fastening members 23, so the fastening members 23 can be turned, and two spacing rods 1B are mounted movably and respectively in the horizontal holes 233. The cylinders 222 of the transmission seat 22 are mounted movably in the inclined holes 232, and the fastening sheets 234 of the fastening members 23 correspond to the insertion slots 215 of the pivoting component 21.

With reference to FIGS. 8 and 9, when no external force is applied on the pulling component 226, the transmission seat 22 moves forward and is pushed by the pressing spring 225. At the moment, each cylinder 222 of the transmission seat 22 is located in the front end of the inclined hole 232, and the fastening members 23 are turned toward to the pivoting arms 211, such that the fastening sheet 234 is mounted in one of the insertion slots 215. A relative angle between the pivoting component 21 and the bottom plate 1 is fixed, so the back rack 2 has a specific back inclined angle relative to the bottom plate 1.

For adjusting the back rack 2 to a specific back inclined angle, the pulling component 226 is pulled to make the transmission seat 22 move backwardly. The cylinder 222 of the transmission seat 22 is moved from the front end to the rear end of the inclined hole 232, and the fastening sheet 234 is separated from one of the insertion slots 215. At the moment, the back rack 2 and the pivoting arms 212 are rotated round the pivoting holes 212 and the back rack 2 is adjusted to a specific back inclined angle, and then the pulling component 226 is released. The transmission seat 22 is repositioned by the stretching springs 224 and the pressing spring 225, and the fastening sheets 234 are mounted into another insertion slot 215 at a different back inclined angle.

Figure 14:
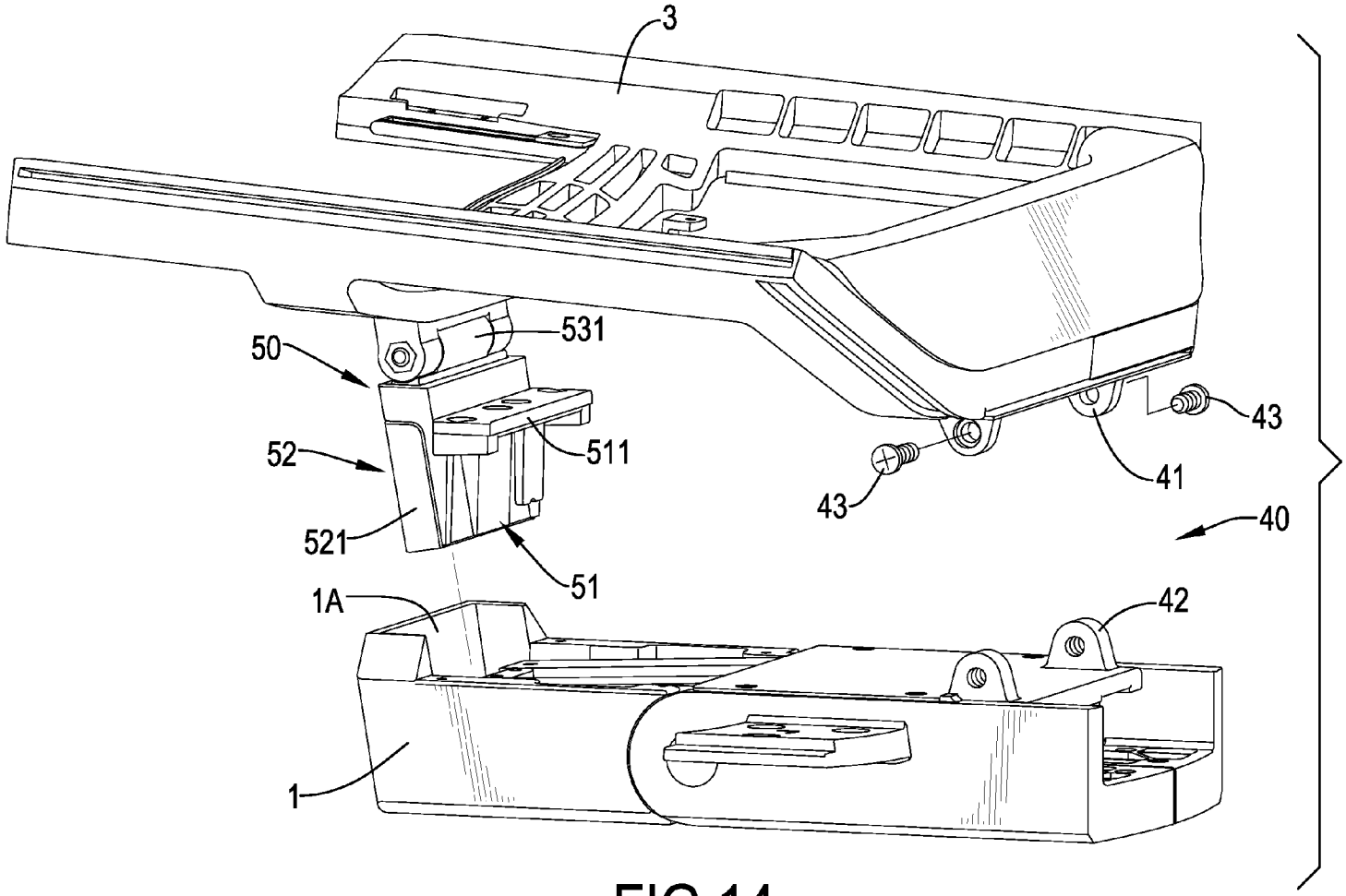
FIG. 14 is an exploded view of the seat frame and the bottom plate of the bottom plate structure in FIG. 1.

With reference to FIGS. 1 and 14, the receiving groove 1A is formed in the top surface of the bottom plate 1 at the front side of the bottom plate 1. The seat frame 3 is rotatably mounted above the bottom plate 1 and has a front end and a bottom surface.

Figure 15:
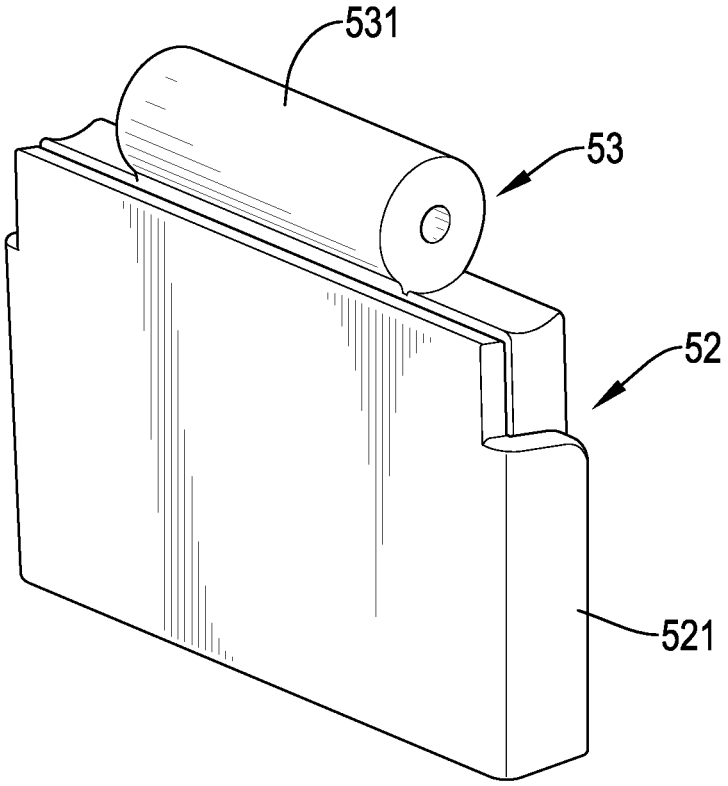
FIG. 15 is an enlarged perspective view of a front adjusting component of the bottom plate structure in FIG. 1.

The adjusting device 30 is mounted between the seat frame 3 and the bottom plate 1 and has a back pivoting component 40 and a front adjusting component 50. With reference to FIGS. 14 and 15, the back pivoting component 40 is mounted between the seat frame 3 and the bottom plate 1 at a rear end of the bottom plate structure. The back pivoting component 40 has two upper pivot holders 41, two lower pivot holders 42 and two pivot pins 43. The upper pivot holders 41 are mounted on the bottom surface of the seat frame 3 at an interval. The lower pivot holders 42 are mounted on the top surface of the bottom plate 1 and are respectively connected to the upper pivot holders 41. The pivot pins 43 are respectively and pivotally connected to the upper pivot holders 41 and the lower pivot holders 42 to enable the seat frame 3 to rotate relative to the bottom plate 1.

The front adjusting component 50 is mounted between the seat frame 3 and the bottom plate 1 at a front end of the bottom plate structure and has a positioning frame 51, a retaining bracket 52, a sliding unit 53, a repositioning block 54 and a positioning block 55. The positioning frame 51 is hollow and has a positioning sheet 511 formed on a back side of the positioning frame 51. The positioning sheet 511 is securely mounted in the receiving groove 1A of the bottom plate 1 to hold the positioning frame 51 securely with the bottom plate 1.

Figure 16:
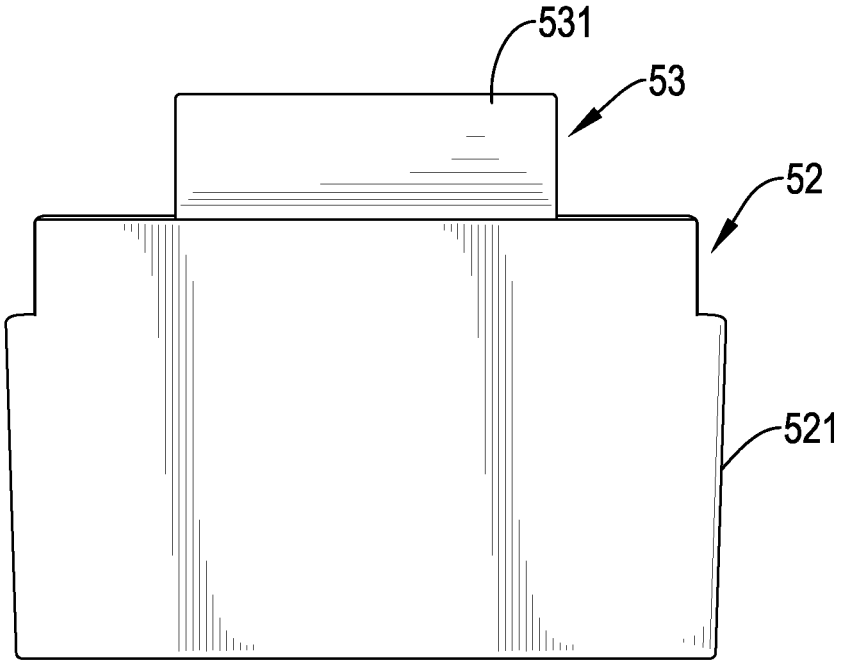
FIG. 16 is a front side view of the front adjusting component of the bottom plate structure in FIG. 15.
Figure 18:
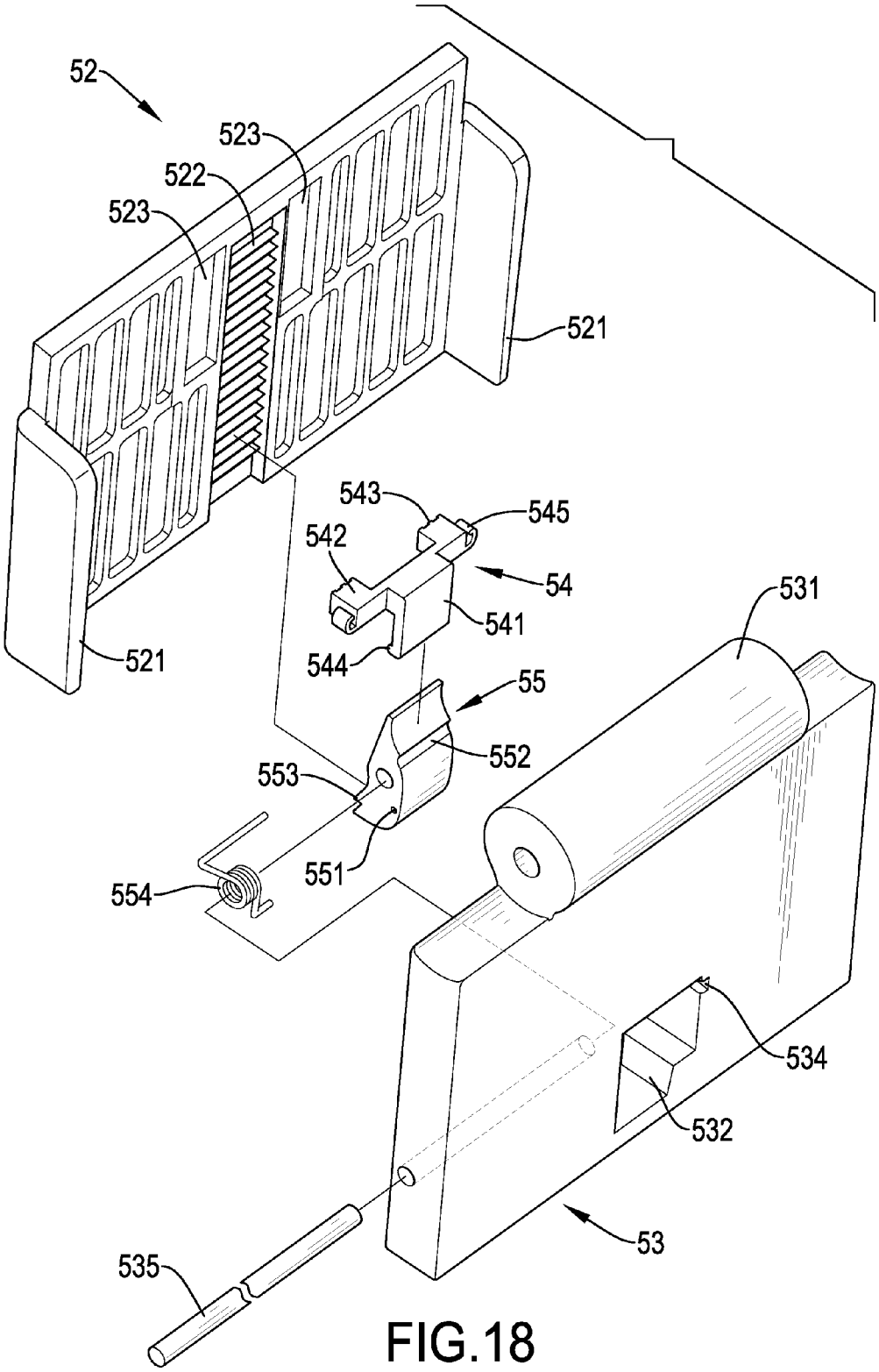
FIG. 18 is another enlarged and exploded view of the front adjusting component of the bottom plate structure in FIG. 1.

The retaining bracket 52 is connected to the positioning frame 51 and is securely mounted in the receiving groove 1A of the bottom plate 1. With reference to FIGS. 15, 16 and 18, the retaining bracket 52 has two panels 521 protruding from two opposite edges of the retaining bracket 52, a toothed portion 522 formed on a rear side of the retaining bracket 52 and mounted between the panels 521, and two limit slots 523 formed on the rear side of the retaining bracket 52 at two opposite sides of the toothed portion 522.

Figure 17:
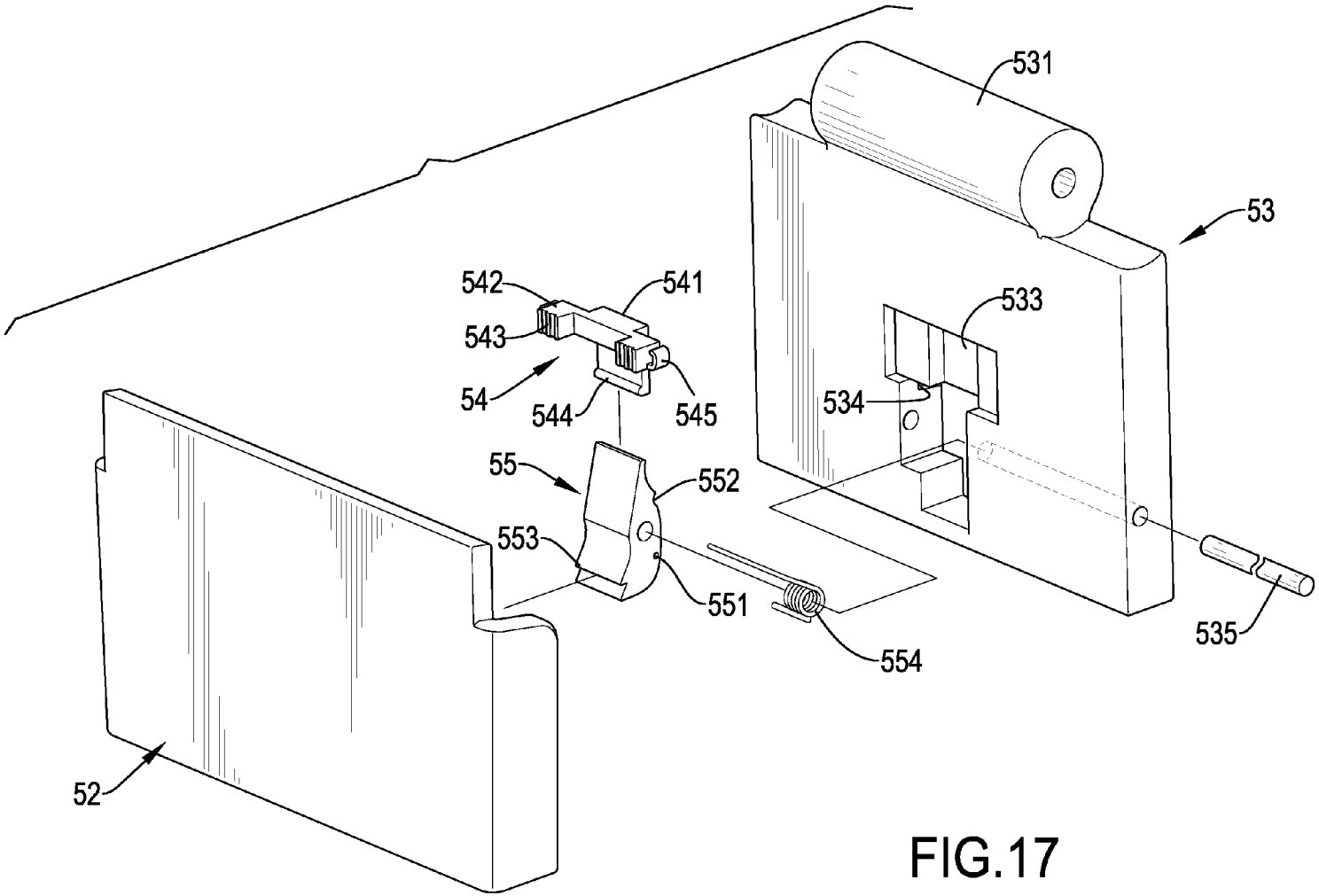
FIG. 17 is an enlarged and exploded view of the front adjusting component of the bottom plate structure in FIG. 1.

With reference to FIGS. 17 and 18, the sliding unit 53 is mounted in the positioning frame 51 to face the retaining bracket 52 between the panels 521 and has a pivot rod 531, a movement groove 532, a vertical groove 533, an inclined groove 534 and a rotation rod 535. The pivot rod 531 is formed on and protrudes from a top edge of the sliding unit 53 and is pivotally connected to the seat frame 3. The movement groove 532 is formed through the sliding unit 53 and faces the toothed portion 522 of the retaining bracket 52. The vertical groove 533 is formed in the sliding unit 53 above the movement groove 532 and communicates with the movement groove 532. The inclined groove 534 is concaved on an inner surface of the movement groove 532. The rotation rod 535 is mounted in the sliding unit 53 and is located in the movement groove 532.

Figure 19:
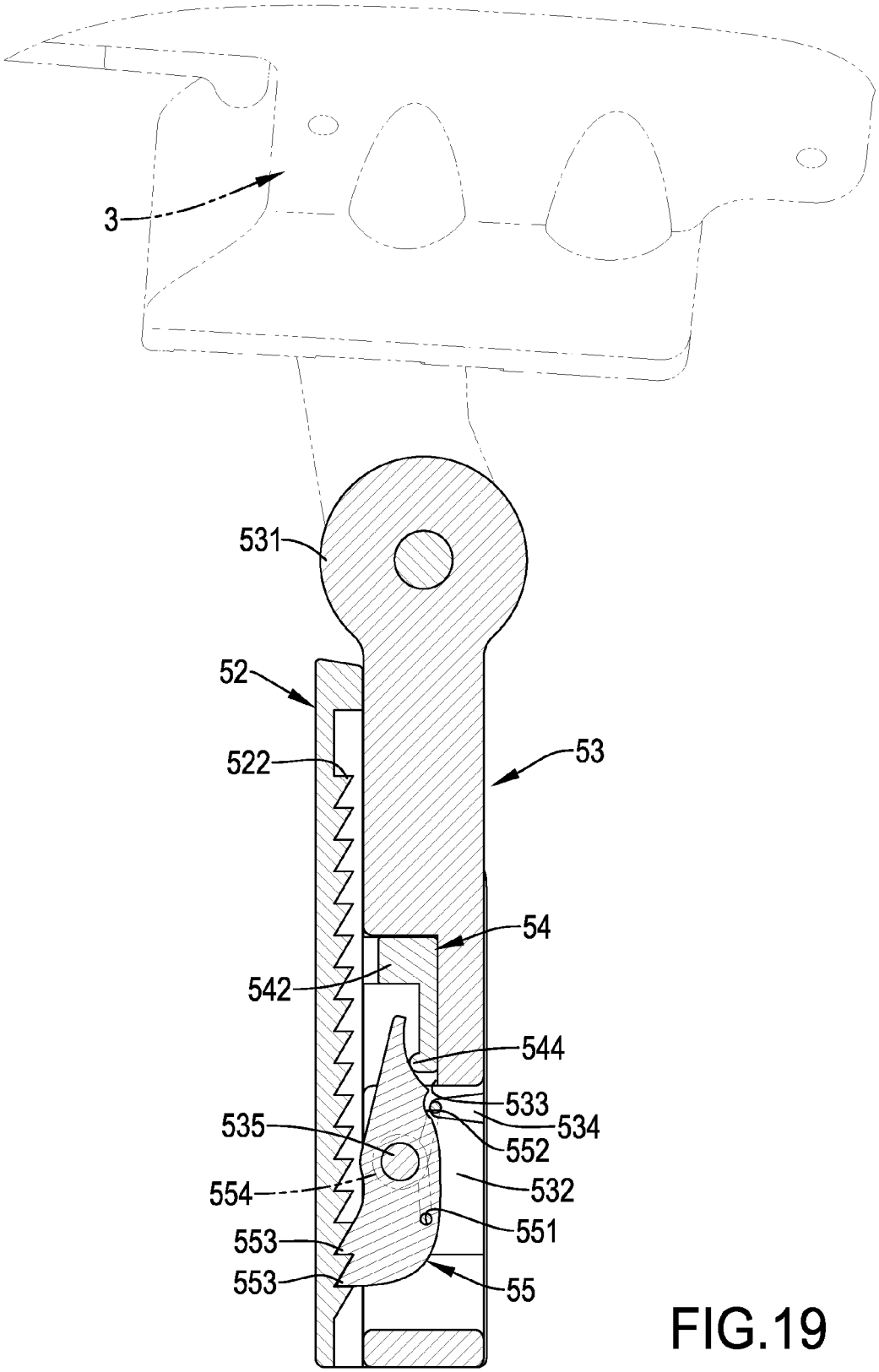
FIG. 19 is a cross-sectional side view of the front adjusting component of the bottom plate structure.

With reference to FIGS. 17 to 19, the repositioning block 54 is mounted movably in the movement groove 532 of the sliding unit 53 and has a protruding portion 541, two lumps 542, two threaded parts 543, a flange 544 and two elastic elements 545. The protruding portion 541 is formed on a rear end of the repositioning block 54, abuts against and is limited by the vertical groove 533. Then, the repositioning block 54 can be moved only relative to the sliding unit 53 in a vertical direction. The lumps 542 protrude from two opposite sides on a guiding end of the repositioning block 54 and face the retaining bracket 52. The threaded parts 543 are respectively formed on the lumps 542. The flange 544 is formed on and protrudes from the guiding end of the repositioning block 54 below the lumps 542 and faces the retaining bracket 52. The elastic elements 545 are respectively mounted on outer surfaces of the repositioning block 54 that are perpendicular to the threaded parts 543.

The positioning block 55 is mounted pivotally in the movement groove 532 below the repositioning block 54 by mounting around the rotation rod 535 of the sliding unit 53, is pressed against the repositioning block 54, and has a positioning hole 551, an engaging recess 552 and multiple engaging teeth 553. The positioning hole 551 is formed in a side surface of the positioning block 55. The positioning block 55 has a torsion spring 554 mounted in the movement groove 532 and mounted around the rotation rod 535 and having two ends. One of the ends of the torsion spring 554 is mounted in the positioning hole 551, and the other end of the torsion spring 554 is mounted into the inclined groove 534 and is pressed against an inner surface of the inclined groove 534. The engaging recess 552 is formed on the positioning block 55 and faces the movement groove 532 of the sliding unit 53. The engaging teeth 553 are formed on the positioning block 55 and engage with the toothed portion 522 of the retaining bracket 52.

So the repositioning block 54 can be moved vertically along the limit slots 523 and the vertical groove 533. For maintaining the moving stability of the repositioning block 54, each elastic element 545 abuts on two inner walls of the limit slot 523.

Figure 20:
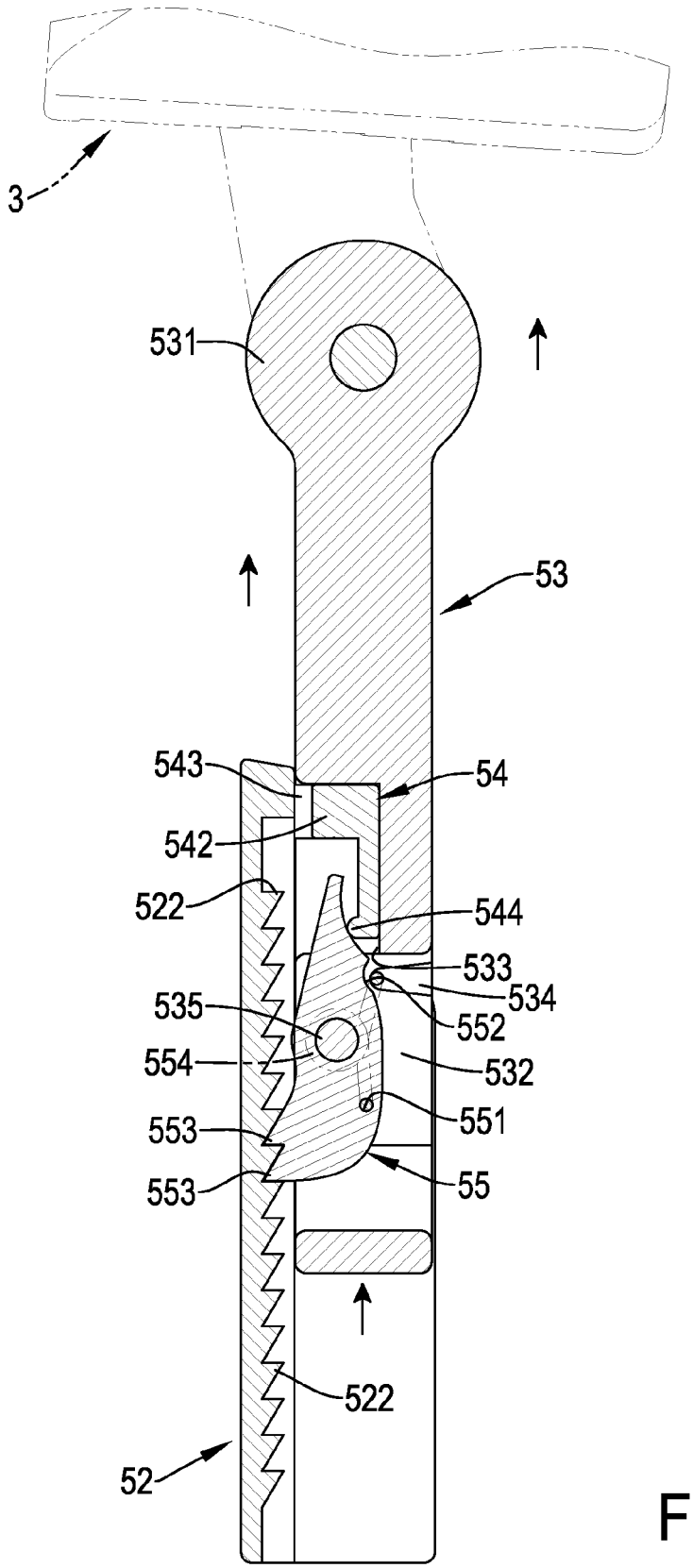
FIG. 20 is an operational side view of the adjusting module of the cushion structure in FIG. 19.

With reference to FIGS. 1, 19 and 20, when adjusting the front inclined angle of the bottom plate structure of a chair, the seat frame 3 is pulled upwardly by an external force to rotate relative to the bottom plate 1 by the back pivoting component 40. At this point, the engaging teeth 553 engage with the toothed portion 522. So the sliding unit 53 can be moved upwardly relative to the retaining bracket 52. The positioning block 55 is in a swing condition and is pushed by the flange 544 to compress the torsion spring 554. Then, the engaging teeth 553 separate from the toothed portion 522. After the sliding unit 53 is moved to the desired angle, the force that pulls the sliding unit 53 is stopped, and the positioning block 55 can be pressed by the torsion spring 554, such that the engaging teeth 553 engage with the toothed portion 522 again to adjust the desired front inclined angle of the seat frame 3 relative to the bottom plate 1.

If the sliding unit 53 needs to descend, the seat frame 3 is moved close to a level status. The sliding unit 53 is still pulled upwards by an external force, and the positioning block 55 is moved upwards with the sliding unit 53. The flange 544 of the repositioning block 54 pushes the positioning block 55 and forces the positioning block 55 to swing relative to the rotation rod 535, such that the engaging teeth disengage from the toothed portion 522. At this point, the seat frame 3 can be pushed downwards and rotated relative to the bottom plate 1 by the back pivoting component 40. When the positioning block 55 is moved downward with the sliding unit 53, the repositioning block 54 moves downward as well, but the abutting force of the repositioning block 54 becomes gradually smaller than the torsion force of the torsion spring 554. So the engaging teeth 553 of the positioning block 55 engage with the toothed portion 522 again, such that the front inclined angle of the seat frame 3 is adjusted and fixed again.

By means of the elastic support device 10 and the slanting device 20 of the present invention, the elastic forces between the back rack 2 and the bottom plate 1 can be adjusted for different requirements and different users, and the back inclined angle of the back rack 2 can thus be adjusted according to the requirements of users. The front inclined angle of the seat frame 3 can be adjusted by using the back pivoting component 40 and the front adjusting component 50 of the adjusting device 30. Accordingly, the seat frame 3 can meet needs of different users with different body shapes or different using demands by adjusting the front inclined angle of the seat frame Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A bottom plate structure of a chair comprising:
- a bottom plate;
- a back rack pivotally connected to the bottom plate; and
- a seat frame mounted on the bottom plate in front of the back rack, and the bottom plate having
  - an elastic support device including
    - at least one resilient sheet mounted in the bottom plate, a front end of the resilient sheet connected securely in the bottom plate, and a rear end of the resilient sheet connected to the back rack in the bottom plate;
    - an adjusting component mounted in the bottom plate under the resilient sheet; and
    - a supporting base movably connected to the adjusting component, the supporting base located under the resilient sheet and contacting the resilient sheet;
  - a slanting device including
    - a pivoting component connected to the back rack and having
    - two pivoting arms pivotally connected to the bottom plate and securely mounted with the back rack;
    - multiple insertion slots oppositely on two inner surfaces of the pivoting arms and arranged in a fan shape; and
    - a transmission seat mounted in a center of the bottom plate and having
      - two cylinders extending from two bottom surfaces of the transmission seat;
      - two guiding portions formed on a bottom of the transmission seat; and
      - a pulling component connected to the transmission seat; and
    - two fastening members connected to two sides in the bottom plate and having
      - two inclined holes respectively mounted through by the cylinders of the transmission seat; and
      - two fastening sheets formed on rear ends of the fastening members and fastening in the insertion slots; and
  - an adjusting device mounted between the bottom plate and the seat frame and including
    - a back pivoting component mounted on a rear end of the seat frame and the bottom plate; and
    - a front adjusting component mounted on a front end of the seat frame and the bottom plate, the front adjusting component used to adjust a front inclined angle of the seat frame relative to the bottom plate.

2. The bottom plate structure of a chair as claimed in claim 1, wherein
- the back pivoting component has
  - two locating sheets protruding from two outer surfaces of the pivoting arms; and
  - an installing base mounted between the pivoting arms and connecting to the back rack; and
- the bottom plate structure of a chair has
  - a handrail component mounted securely on one of the locating sheets.

3. The bottom plate structure of a chair as claimed in claim 1, wherein
- each one of the fastening members has a horizontal hole formed behind a rear end of the inclined hole;
- the fastening sheet extends from an outer surface of the horizontal hole of the fastening member; and
- the bottom plate has two spacing rods mounted movably in the horizontal holes.

4. The bottom plate structure of a chair as claimed in claim 1, wherein
- the transmission seat has a through groove formed through the transmission seat between the guiding portions, one end of the pulling component positioned at a front end of the through groove.

5. The bottom plate structure of a chair as claimed in claim 1, wherein
- the transmission seat has two stretching springs connected respectively to a front end of the transmission seat and a front end of the bottom plate;

a pressing spring connected to a rear end of the transmission seat, the stiffness of the pressing spring being bigger than the stiffness of the stretching spring.

6. The bottom plate structure of a chair as claimed in claim 5, wherein the transmission seat has a through groove formed through the transmission seat between the guiding portions, one end of the pulling component positioned at a front end of the through groove.

7. The bottom plate structure of a chair as claimed in claim 5, wherein each one of the fastening members has a horizontal hole formed behind a rear end of the inclined hole;

the fastening sheet extends from an outer surface of the horizontal hole of the fastening member; and the bottom plate has two spacing rods mounted movably in the horizontal holes.

8. The bottom plate structure of a chair as claimed in claim 5, wherein the pivoting component has two locating sheets protruding from two outer surfaces of the pivoting arms; and an installing base mounted between the pivoting arms and connecting to the back rack; and the bottom plate structure of a chair has a handrail component mounted securely on one of the locating sheets.

9. The bottom plate structure of a chair as claimed in claim 1, wherein the adjusting component has an adjusting rod mounted pivotally in the bottom plate; and a transmission rod mounted vertically and pivotally in the bottom plate and engaging with the adjusting rod.

10. The bottom plate structure of a chair as claimed in claim 9, wherein the elastic support device has two resilient sheets parallel with each other; and the supporting base has two lumps respectively extending from a top surface of the supporting base and contacting the resilient sheets; and two track portions formed on a bottom surface of the supporting base.

11. The bottom plate structure of a chair as claimed in claim 9, wherein the adjusting component has a turning knob mounted through a side surface of the bottom plate and connected to the adjusting rod;

the adjusting rod has a worm;

the transmission rod has a worm wheel, the worm of the adjusting rod engaged with the worm wheel of the transmission rod; and the supporting base has a screw hole formed through a middle of the supporting base and screwed with the transmission rod.

12. The bottom plate structure of a chair as claimed in claim 11, wherein the elastic support device has two resilient sheets parallel with each other; and the supporting base has two lumps respectively extending from a top surface of the supporting base and contacting the resilient sheets; and two track portions formed on a bottom surface of the supporting base.

13. The bottom plate structure of a chair as claimed in claim 1, wherein the bottom plate has a receiving groove formed in a top surface of the bottom plate at the front side of the bottom plate; and the front adjusting component of the adjusting device has a positioning frame mounted in the bottom plate;

a retaining bracket connected to the positioning frame and securely mounted in the receiving groove of the bottom plate;

a sliding unit mounted in the positioning frame to face the retaining bracket and pivotally connected to the seat frame;

a repositioning block mounted in the sliding unit; and a positioning block mounted pivotally in the sliding unit below the repositioning block.

14. The bottom plate structure of a chair as claimed in claim 13, wherein the back pivoting component has two upper pivot holders mounted on a bottom surface of the seat frame at an interval;

two lower pivot holders mounted on the top surface of the bottom plate and respectively connected to the upper pivot holders; and two pivot pins respectively and pivotally connected to the upper pivot holders and the lower pivot holders.

15. The bottom plate structure of a chair as claimed in claim 13, wherein the retaining bracket has a toothed portion formed on a rear side of the retaining bracket;

the sliding unit has a rotation rod mounted in the sliding unit;

the positioning block is mounted pivotally in the sliding unit by the rotation rod and has a torsion spring mounted around the rotation rod and having two ends, one end of the torsion spring mounted in the positioning block, and the other end of the torsion spring mounted into the sliding unit;

multiple engaging teeth formed on the positioning block and engaging with the toothed portion of the retaining bracket;

an engaging recess formed on the positioning block and facing the sliding unit; and the repositioning block is mounted movably in the sliding unit and has a flange protruding from a guiding end of the repositioning block and facing the retaining bracket.

16. The bottom plate structure of a chair as claimed in claim 15, wherein the back pivoting component has two upper pivot holders mounted on a bottom surface of the seat frame at an interval;

two lower pivot holders mounted on the top surface of the bottom plate and respectively connected to the upper pivot holders; and two pivot pins respectively and pivotally connected to the upper pivot holders and the lower pivot holders.

17. The bottom plate structure of a chair as claimed in claim 15, wherein the sliding unit has a movement groove formed on the sliding unit and facing the toothed portion of the retaining bracket; and a vertical groove formed in the sliding unit above the movement groove;

the repositioning block has a protruding portion formed on a rear end of the repositioning block, and abutting against and limited by the vertical groove;

two lumps protruding from two opposite sides on the guiding end of the repositioning block and facing the retaining bracket; and the retaining bracket has two limit slots formed on the rear side of the retaining bracket and disposed on two sides of the toothed portion, the limit slots corresponding in position to the lumps.

18. The bottom plate structure of a chair as claimed in claim 17, wherein the repositioning block has two threaded parts respectively formed on the lumps; and two elastic elements respectively mounted on outer surfaces of the lumps that are perpendicular to the threaded parts, each elastic element abutting an inner wall of the limit slot.

* * * * *